US007268994B2

(12) United States Patent
Kondo

(10) Patent No.: US 7,268,994 B2
(45) Date of Patent: Sep. 11, 2007

(54) RELAY DRIVING APPARATUS AND METHOD HAVING RELAY CONTACT TURN-ON HOLDING FUNCTION

(75) Inventor: Yoshio Kondo, Anjo (JP)

(73) Assignees: Anden Co., Ltd., Anjo (JP); DENSO CORPORATION, Kariya (JP)

( * ) Notice: Subject to any disclaimer, the term of this patent is extended or adjusted under 35 U.S.C. 154(b) by 507 days.

(21) Appl. No.: 10/878,394

(22) Filed: Jun. 29, 2004

(65) Prior Publication Data

US 2005/0024102 A1 Feb. 3, 2005

(30) Foreign Application Priority Data

Jul. 30, 2003 (JP) ..... 2003-282896

(51) Int. Cl.
*H01H 47/00* (2006.01)

(52) U.S. Cl. ..... 361/160

(58) Field of Classification Search ..... 361/160
See application file for complete search history.

(56) References Cited

U.S. PATENT DOCUMENTS 3,571,659 A * 3/1971 Anzai et al. ..... 361/55
6,518,764 B2 * 2/2003 Shirato ..... 324/413
6,798,633 B1 * 9/2004 Rossbach ..... 361/152

FOREIGN PATENT DOCUMENTS

JP B2-63-62052 12/1988
JP A-10-255627 9/1998

* cited by examiner

*Primary Examiner*—Stephen W. Jackson
(74) *Attorney, Agent, or Firm*—Posz Law Group, PLC

(57) ABSTRACT

A relay driving apparatus has a control circuit, which supplies a first voltage to a relay coil in response to a relay driving signal to turn on a relay contact, and thereafter a second voltage lower than the first voltage to the relay coil to keep an ON state of the relay contact. The apparatus also has a detection circuit, which is connected in a coil current supply path and detects a state change of the relay contact to an OFF state from the ON state based on a current change in the coil current. The control circuit supplies the first voltage again to the relay coil in response to the state change detected by the detection circuit to restore the ON state.

8 Claims, 4 Drawing Sheets

RELAY DRIVING APPARATUS AND METHOD HAVING RELAY CONTACT TURN-ON HOLDING FUNCTION

CROSS REFERENCE TO RELATED APPLICATION

This application is based on and incorporates herein by reference Japanese Patent Application No. 2003-282896 filed on Jul. 30, 2003.

FIELD OF THE INVENTION

The present invention relates to a relay driving apparatus and method for driving an electromagnetic relay which has a relay coil and a relay contact and holding a relay contact turn-on state against external disturbances such as vibrations.

BACKGROUND OF THE INVENTION

In a conventional relay driving apparatus, a predetermined voltage is applied to a relay coil to turn on a relay contact and thereafter a voltage is continuously applied to keep the relay contact turned on. The predetermined voltage must be set to be sufficient to turn the relay contact to its ON state from its OFF state. If this same voltage is continuously applied thereafter, the relay coil will overheat due to heat generation in the relay coil. Therefore, it is a general practice to set a first voltage Va applied to the relay coil to turn on the relay contact to be high, and set a second voltage Vb applied thereafter to keep the relay contact turned on to be lower than the first voltage Va.

The relay contact, however, tends to turn off due to vibrations or the like, particularly when the relay is used in a vibrating environment such as a vehicle. JP 63-62052 (JP-A-57-55026) proposes a relay driving apparatus which detects a turn-off of a relay contact in spite of a continued supply of a voltage to a relay coil.

One example of such a relay driving apparatus is shown in FIG. 5. When an ON signal is applied to a relay driving apparatus J1 through an input terminal J1*a*, a timer circuit J2 produces a high level signal for a predetermined period t1 which is required to fully turn on a relay contact J9 from the OFF state. This high level signal is applied to a Va-voltage instruction circuit J4 through an OR circuit J3. The Va-voltage instruction circuit J4 responsively produces a first voltage Va. This first voltage Va is applied to a relay coil J8 of a relay J7 through an OR circuit J5 and an output circuit J6. Thus, a relay contact J9 is turned on to drive an electric load J12 by magnetic flux generated by the relay coil J8 in response to the first voltage Va.

After the predetermined period t1, the timer circuit J2 changes its high level signal to a low level signal thereby to disable the Va-voltage instruction circuit J4 to continue to produce the first voltage Va. An AND circuit J10 having an inverting input terminal, however, produces a high level signal. A Vb-voltage instruction circuit J11 responsively produces a second voltage Vb. This second voltage Vb is applied to the relay coil J8 through the OR circuit J5 and the output circuit J6. As a result, the relay contact J9 is kept turned on by magnetic flux generated by the relay coil J8 in response to the second voltage Vb.

If the relay contact J9 turns off in its ON state due to vibrations or the like, the voltage at the junction between the relay contact J9 and the load J12 fluctuates. This voltage is applied to a timer circuit J15 through a wire harness J13 and an amplifier J14 having an inverting input terminal. When the voltage on the wire harness J13 falls due to turn-off of the relay contact J9, the timer circuit J15 produces a high level signal of the same period t1 after an elapse of a predetermined time period t2. The Va-voltage instruction circuit J4 receives this high level signal through an AND circuit J16 and the OR circuit J3. As a result, the Va-voltage instruction circuit J4 produces the first voltage Va to energize the relay coil J8 again and restore the ON state of the relay contact J9.

The relay J7 and the load J12 are provided apart from the relay driving apparatus J1. Therefore, the wire harness J13 is required to connect the relay J7 and the load J12 to the relay driving apparatus J1, thus adding costs and complexity. For reducing costs and complexity, the above relay contact turn-off detection is limited to only some of a plurality of electric loads.

Further, if the load J12 is an electric motor or the like, the motor continues to rotate for a certain period even after the turn-off of the relay contact J9, and a voltage is applied to the amplifier J14. Therefore, the turn-off of the relay contact J9 cannot be detected accurately.

SUMMARY OF THE INVENTION

It is therefore an object of the present invention to provide a relay driving apparatus and method, which can keep a relay contact turned on in simple construction even when the relay contact tends to turn off in its ON state.

According to the present invention, a relay driving apparatus and a method supplies a first voltage to a relay coil in response to a relay driving signal to turn on a relay contact from its OFF state, and thereafter a second voltage to the relay coil to keep an ON state of the relay contact. The apparatus and method detects a state change of the relay contact to an OFF state from the ON state based on a current change in a coil current supplied to the relay coil. Upon detection of the state change, the apparatus and method supplies the first voltage again to the relay coil to restore the ON state.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

First Embodiment

Figure 1:
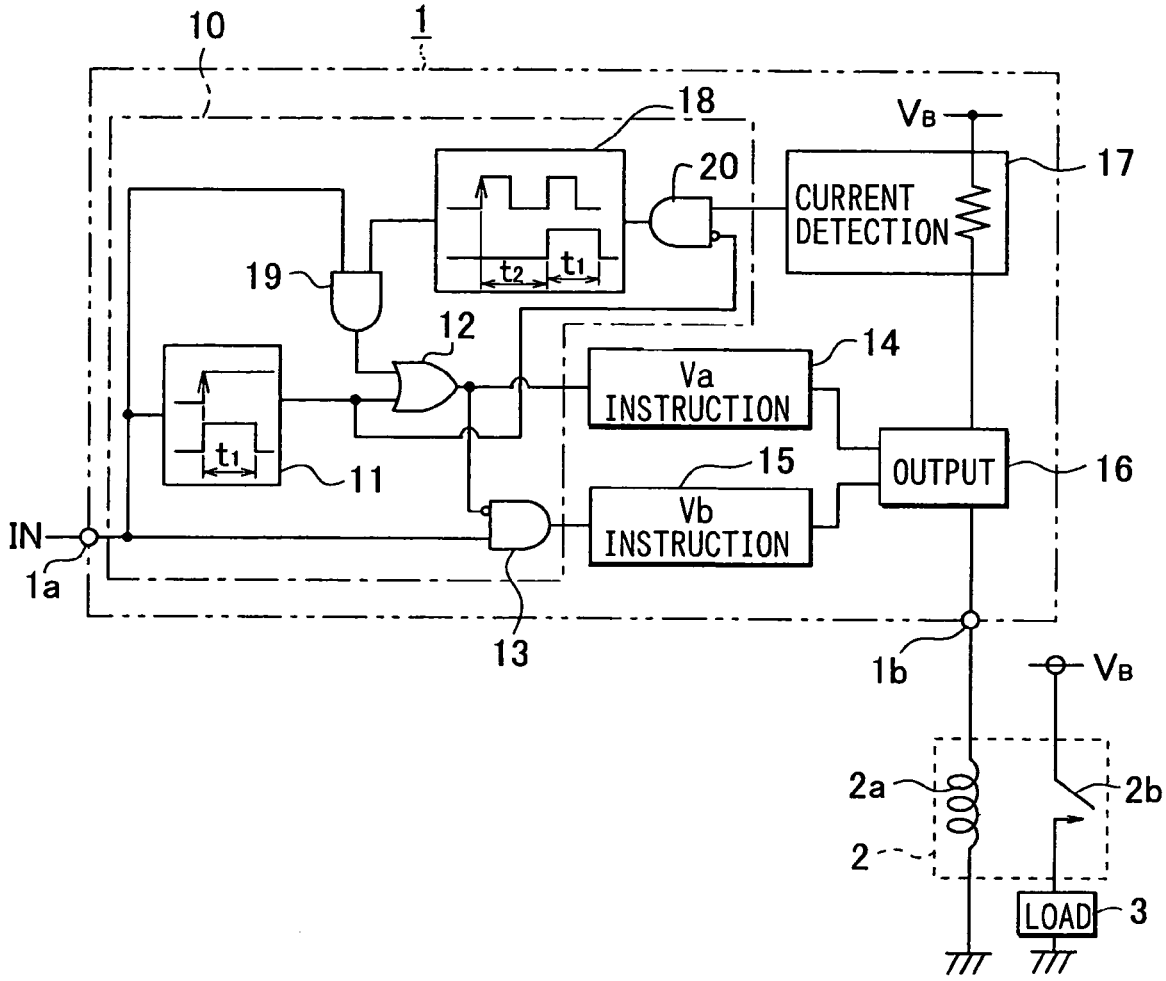
FIG. 1 is a circuit diagram showing a relay driving apparatus according to the first embodiment of the present invention.

Referring first to FIG. 1, a relay driving apparatus 1 is connected to one terminal of a relay coil 2*a* of a relay 2 to control turn-on and turn-off of a relay contact 2*b* of the relay 2. Thus, the relay driving apparatus 1 controls a power supply to an electric load 3 from a power source VB which generates 12V, for instance.

The relay driving apparatus 1 is constructed with a first timer circuit 11, an OR circuit 12, an AND circuit 13, a Va-voltage instruction circuit 14, a Vb-voltage instruction circuit 15, an output circuit 16, a current detection circuit 17, a second-timer circuit 18, an AND circuit 19 and an AND circuit 20. The first timer circuit 11, the OR circuit 12, the AND circuit 13, the second timer circuit 18, the AND circuit 19 and the AND circuit 20 form a control circuit 10. This control circuit 10 controls the Va-voltage instruction circuit 14 and the Vb-voltage instruction circuit 15 based on the output of the current detection circuit 17.

The relay driving apparatus 1 has an input terminal 1*a* to receive a relay driving signal from an outside such as an electronic control unit (ECU) for the load 3. When the relay driving signal is applied to the input terminal 1*a*, the first timer circuit 11 detects a rise of the relay driving signal and produces a high level signal for a predetermined period t1 from the rise of the relay driving signal.

The OR circuit 12 receives the outputs of the first timer circuit 11 and the AND circuit 19, and produces a high level signal when either of those outputs is at the high level. The AND circuit 13 produces a signal based on the output of the OR circuit 12 and the relay driving signal applied to the input terminal 1*a*. The AND circuit 13 is connected to the OR circuit 12 through its inverting input terminal. Therefore, the AND circuit 13 produces a high level signal when the output of the OR circuit 12 is at the low level and the relay driving signal is at the high level.

The Va-voltage instruction circuit 14 produces a first voltage instruction signal to the output circuit 16 in response to the high level signal applied from the OR circuit 12, so that a first voltage Va (for instance 12V) is supplied to the relay coil 2*a*. The Vb-voltage instruction circuit 15 produces a second instruction signal to the output circuit 16 in response to the high level signal applied from the AND circuit 13, so that a second voltage Vb (for instance 6V) is supplied to the relay coil 2*a*.

The output circuit 16 produces an output voltage based on the instruction signals applied from the Va-voltage instruction circuit 14 and the Vb-voltage instruction circuit 15. The output circuit 16 and the relay coil 2*a* are connected to each other through an output terminal 1*b* of the relay driving apparatus 1. The output circuit 16 is connected to receive a power supply from a power source VB. As a result, the voltage applied to the relay coil 2*a* is varied by the output voltage Va or Vb of the output circuit 16. Specifically, the output circuit 16 changes a current flow path from the power source VB to the relay coil 2*a* in accordance with the instruction signals of the Va-voltage instruction circuit 14 and the Vb-voltage instruction circuit 15. Thus, the output circuit 16 adjusts the voltage supplied to the relay coil 2*a* by adjusting a voltage drop in the current flow path from the power source VB to the relay coil 2*a*.

The output circuit 16 fixes the voltage at the output terminal 1*b* to the higher one of the voltages instructed by the two instruction circuits 14 and 15. Specifically, when the Va-voltage instruction circuit 14 receives the high level signal from the OR circuit 12, the output circuit 16 applies the first voltage Va to the relay coil 2*a*. When the Va-voltage instruction circuit 14 receives no high level signal from the OR circuit 12 but the Vb-voltage instruction circuit 15 receives the high level signal from the AND circuit 13, the output circuit 16 applies the second voltage Vb to the relay coil 2*a*. When both the Va-voltage instruction circuit 14 and the Vb-voltage instruction circuit 15 receive no high level signals from the circuits 12 and 13, the output circuit 16 applies no voltage to the-relay coil 2*a*.

The current detection circuit 17 is connected between the power source VB and the output circuit 16, that is, within the coil current supply-path to the relay coil 2*a*. The current detection circuit 17 detects changes of the coil current flowing to the relay coil 2*a* thereby to detect turn-off of the relay contact 2*b*. Specifically, the current detection circuit 17 produces a high level signal indicative of the change of the relay contact 2*b* from the ON state to OFF state, when the increasing change of the coil current reaches a predetermined threshold level. This threshold level is set such that the current detection circuit 17 does not produce the high level signal in response to noise-caused small changes in the coil current.

The AND circuit 20 receives the outputs of the first timer circuit 11 and the current detection circuit 17. The AND circuit 20 is connected to the first timer circuit 11 through an inverting input terminal. As a result, the AND circuit 20 produces a high level signal only when the current detection circuit 17 produces the high level signal indicative of the turn-off of the relay contact 2*b* and the first timer circuit 11 produces a low level signal after the time period t1.

The second timer circuit 18 receives the output of the current detection circuit 17 to produce a high level signal for the same period t1 of the output of the first timer circuit 11. Specifically, when the output of the AND circuit 20 changes from the low level to the high level, the second timer circuit 18 measures time and produces the high level signal for the period t1 after a predetermined period t2. This predetermined period t2 is set to correspond to a period of arc current which is generated when the coil current changes, so that the relay coil 2*a* is activated again after the arc current disappears.

The AND circuit 19 produces a signal based on the outputs of the relay driving signal applied through the input terminal 1*a* and the output from the second timer circuit 18. Specifically, the AND circuit 29 produces a high level signal only when both the relay driving signal and the output of the second timer circuit 18 are at the high level. This high level signal is applied to the Va-voltage instruction circuit 14 through the OR circuit 12, so that the relay coil 2*a* is supplied with the first voltage Va to turn on the relay contact 2*b* again.

Figure 2:
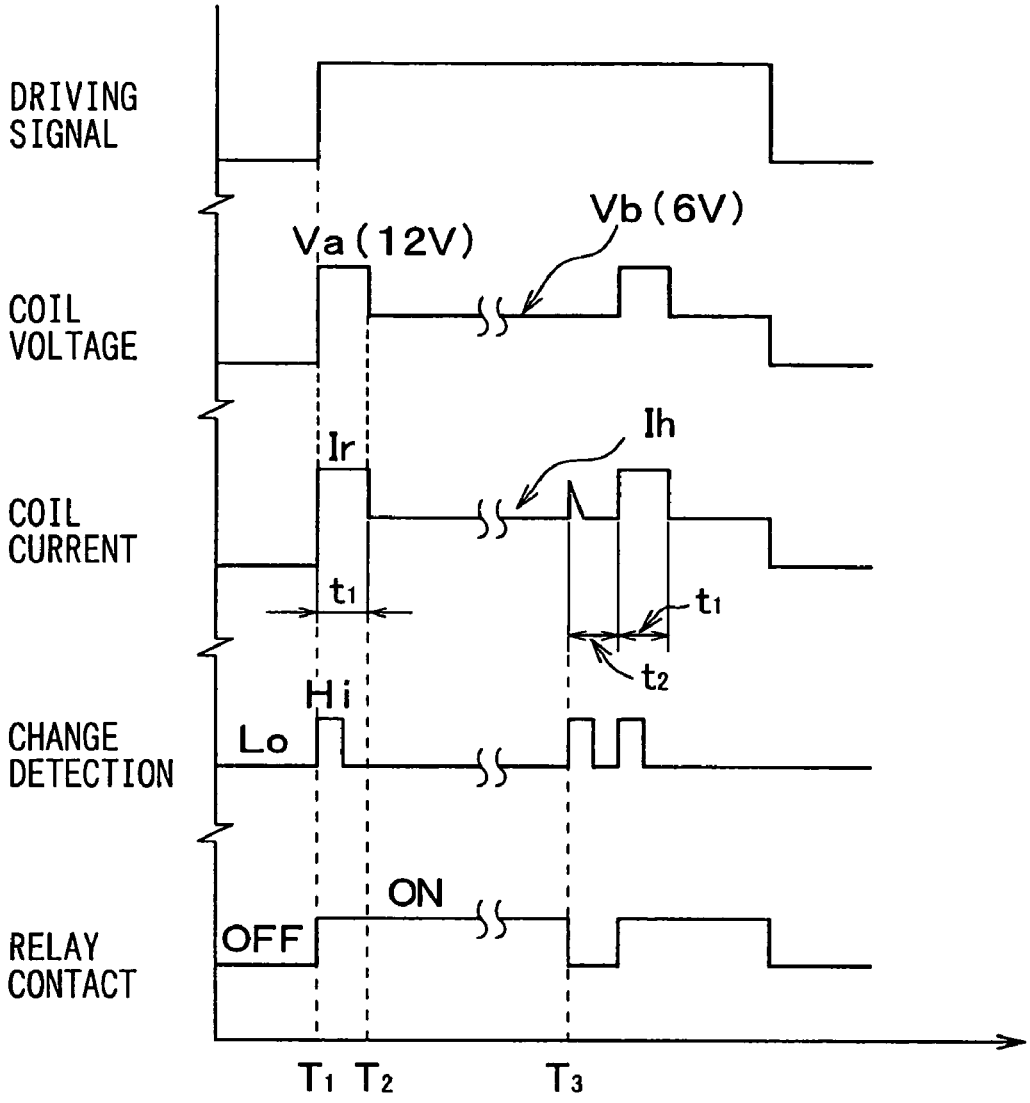
FIG. 2 is a timing diagram showing operations of the first embodiment.

The relay driving apparatus 1 operates as shown in FIG. 2.

When the relay driving signal (high level signal) is applied at time T1, the first timer circuit 11 produces the high level signal for the period t1. This high level signal is applied to the Va-voltage instruction circuit 14 through the OR circuit 12, and the first voltage Va is applied to the relay coil 2*a* by the output circuit 16. The relay coil 2*a* thus generates magnetic flux which in turn attracts and turn on the relay contact 2*b* from the OFF state. With this turn-on of the relay contact 2*b*, the electric load 3 is supplied with the power supply voltage from the power source VB.

At time T2 which is after the period t1 from time T1, the first timer circuit 11 produces the low level signal and the Va-voltage instruction circuit 14 does not operate. The AND circuit 13 however produces the high level signal in response to the low level signal from the OR circuit 12 because of its inverting input. This high level signal is applied to the Vb-voltage instruction circuit 15, and the second voltage Vb is applied to the relay coil 2*b* by the out put circuit 16. The relay coil 2*a* is thus energized with a holding current Ih lower than a rated current Ir supplied in the period t1 and continues to generate magnetic flux. This magnetic flux is less than in the period t1 but sufficient to maintain the ON state of the relay contact 2*b*. Thus, the relay contact 2*b* continues the power supply from the power source VB to the load 3.

If the relay contact 2*b* starts to turn off due to vibrations at time T3 during its ON state, the coil current flowing in the relay coil 2*a* changes. Specifically, it increases toward the rated current Ir temporarily. The current detection circuit 17 detects this increasing change of the coil current and produces the high level signal when this coil current change exceeds the threshold. The second timer circuit 18 produces the high level signal for the period t1 again after the predetermined period t2. With this high level signal together with the relay driving signal (high level) applied to the input terminal 1*a*, the AND circuit 19 and the OR circuit 12 drives the Va-voltage instruction circuit 14 so that the output circuit 16 responsively supply the first voltage Va to the relay coil 2*a* to turn on the relay contact 2*b* again.

In this embodiment, the turn-off of the relay contact 2*b* in its ON state is detected in response to the change in the coil current supplied to the relay coil 2*a*. As a result, no wire harness is necessitated to connect the relay contact 2*b* for detecting the turn-off of the relay contact 2*b*.

Second Embodiment

Figure 3:
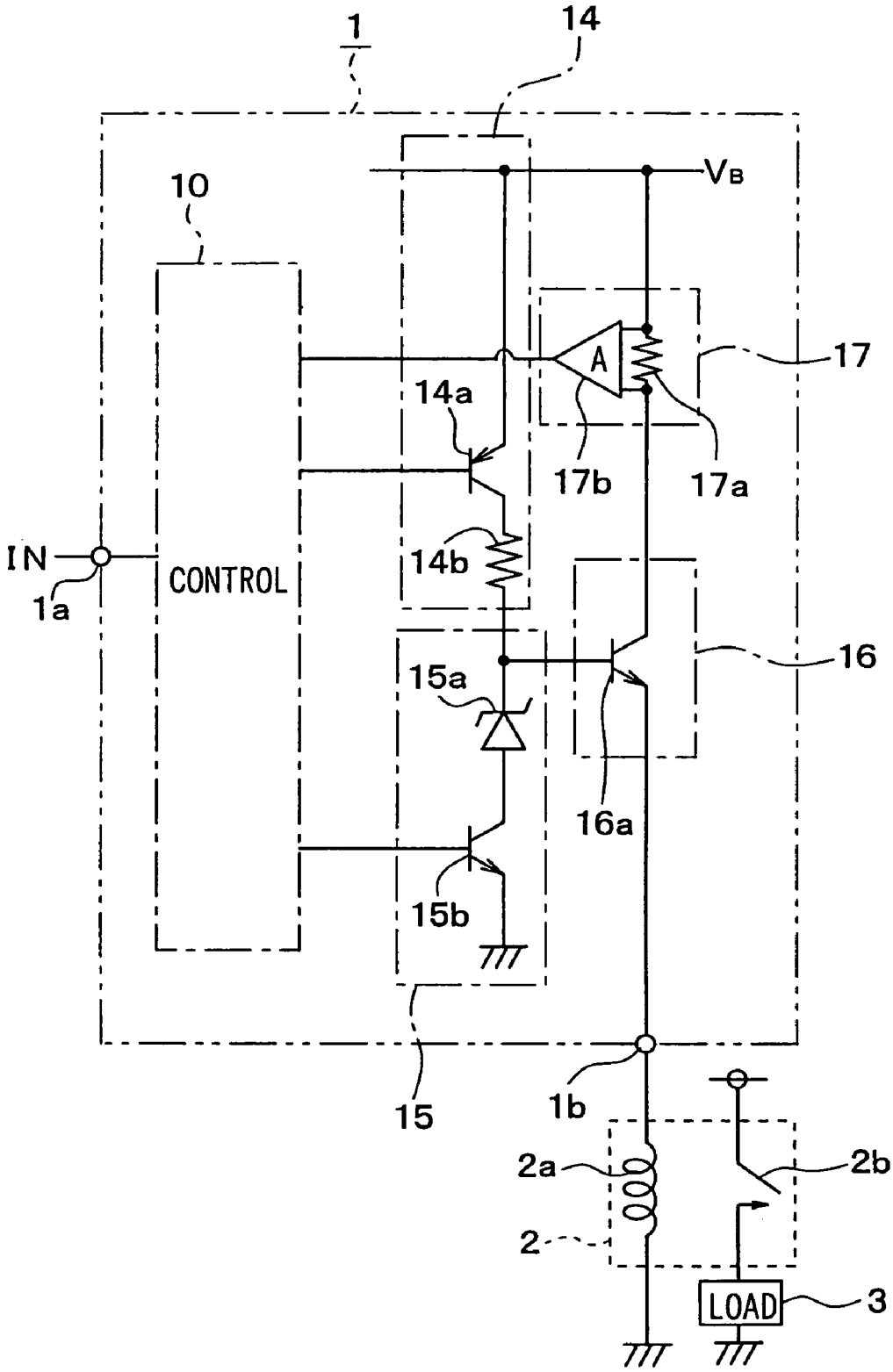
FIG. 3 is a circuit diagram showing a relay driving apparatus according to the second embodiment of the present invention.
Figure 4:
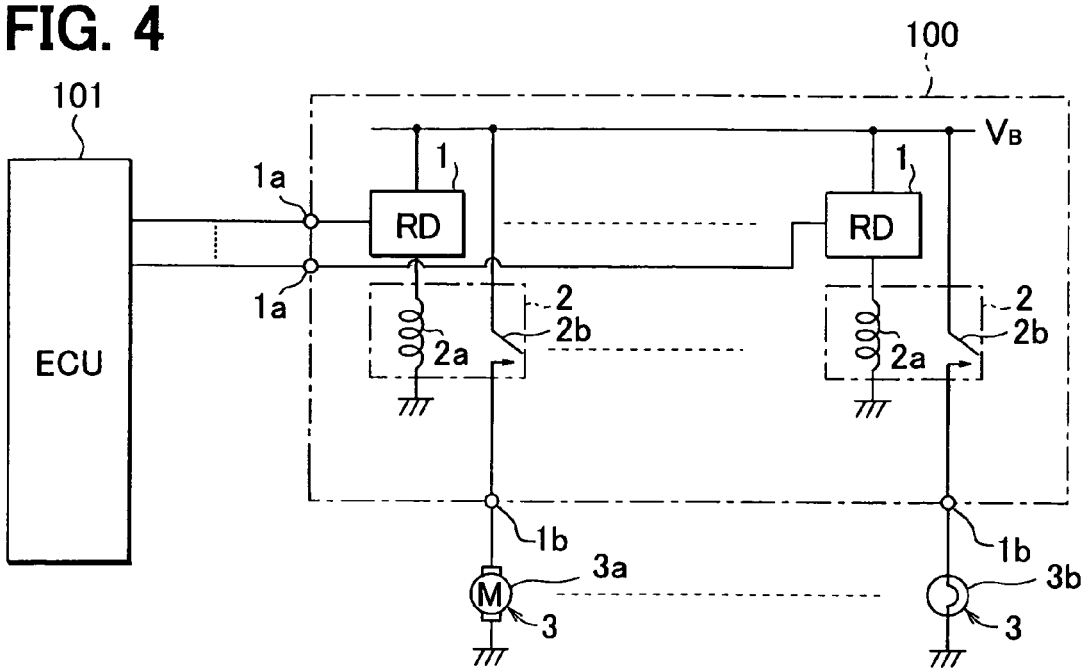
FIG. 4 is a circuit diagram showing a relay driving apparatus according to the third embodiment of the present invention.

In the second embodiment, as shown in FIG. 3, the Va-voltage instruction circuit 14 is constructed with a PNP transistor 14*a* and a resistor 14*b*. The transistor 14*a* turns on and off the power supply from the power source VB in response to the output from the control circuit 10. Specifically, the transistor 14*a* turns on when a low level signal is applied to its base from the control circuit 10 during the period t1. The resistor 14*b* is provided for limiting current flow. For this purpose, the control circuit 10 is constructed to produce the low level signal to the Va-voltage instruction circuit 14 during a period in which the relay coil 2*a* is required to be energized to start turning on the relay contact 2*b*.

The Vb-voltage instruction circuit 15 is constructed with a Zener diode 15*a* and an NPN transistor 15*b*. The transistor 15*b* turns on when a high level signal is applied to its base from the control circuit 10.

The output circuit 16 is constructed with an NPN transistor 16*a*. The transistor 16*a* receives at its base a voltage developed at the junction between the Va-voltage instruction circuit 14 and the Vb-voltage instruction circuit 15 so that the relay coil 2*a* is supplied with a voltage corresponding to this junction voltage.

The current detection circuit 17 is constructed with a current detection resistor 17*a* and an operational amplifier 17*b*. Input terminals of the operational amplifier 17*b* are connected to both ends of the resistor 17*a* so that the amplifier 17*b* produces an output signal proportional to a voltage across the resistor 17*a*.

The relay driving apparatus 1 in this embodiment also operates as shown in FIG. 2.

When the level of the relay driving signal applied to the input terminal 1*a* becomes high at time T1, the control circuit 10 applies the low level signals to both circuits 14 and 15 for the period t1. As a result, the transistor 14*a* turns on and the transistor 15*b* turns off.

With the transistor 14*a* in the ON state, a current flows into the base of the transistor 16*a* from the power source VB through the resistor 14*b*, and the transistor 16*a* turns on. Thus, generally the same voltage as the voltage (12V) of the power supply VB is supplied to the relay coil 2*a* to turn on the relay contact 2*b* from the OFF state.

At time T2 after the period t1, the control circuit 10 applies the low level to the Va-voltage instruction circuit 14 and the high level signal to the Vb-voltage instruction circuit 15. As a result, both transistors 14*a* and 15*b* turn on. Thus, the base voltage of the transistor 16*a* of the output circuit 16 is regulated to the fixed voltage (for instance 6V) of the Zener diode 15*a*, so that this regulated voltage is supplied to the relay coil 2*a* to hold the ON state of the relay contact 2*b* with the holding current Ih.

When the relay driving signal changes to the low level, the control circuit 10 responsively produces the high level signal to the Va-voltage instruction circuit 14 and the low level signal to the Vb-voltage instruction circuit 15. Since both transistors 14*a* and 15*b* turns off and the transistor 16*a* also turns off, no voltage is supplied to the relay coil 2*a*.

Third Embodiment

Figure 5:
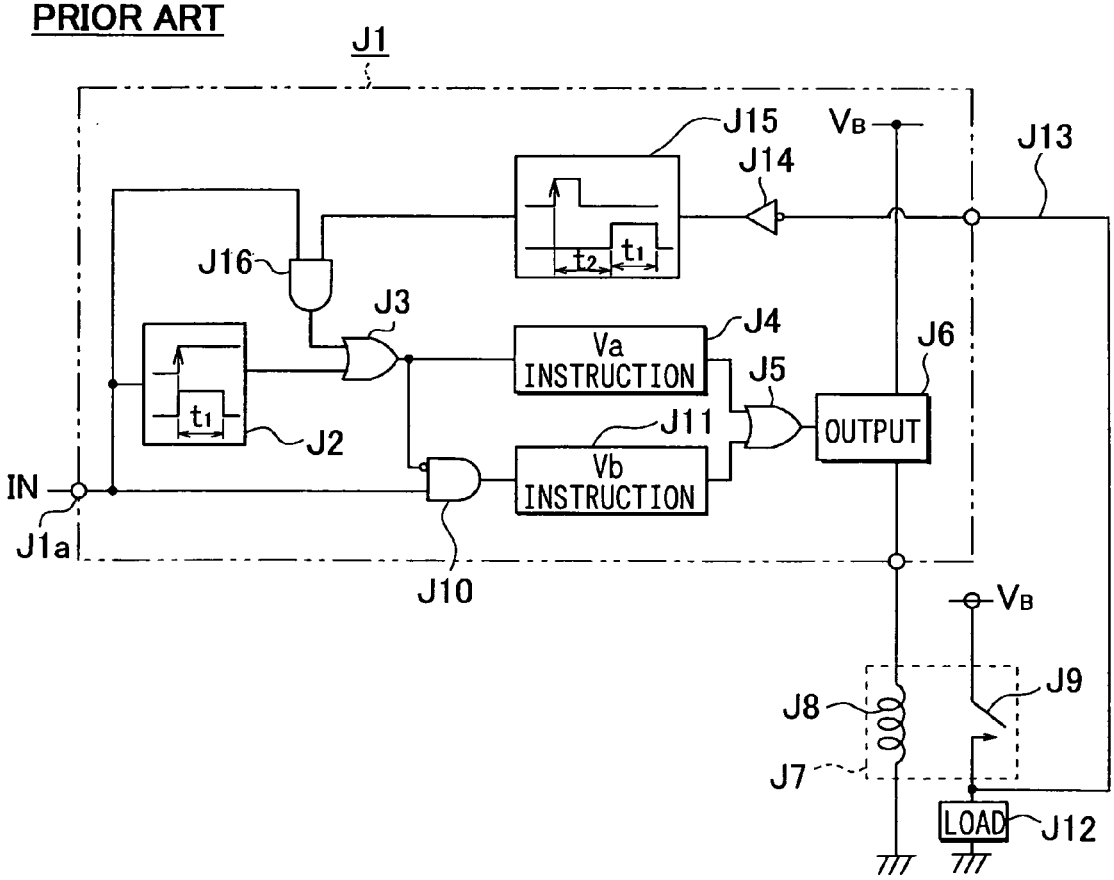
FIG. 5 PRIOR ART
FIG. 5 is a circuit diagram showing a conventional relay driving apparatus.

In the third embodiment, as shown in FIG. 3, a plurality of relay driving apparatuses (RD) 1 shown in FIG. 1 or 3 is provided for driving a plurality of loads 3 such as a motor 3*a*, a lamp 3*b*, etc. The relay driving apparatuses 1 thus form a relay module 100. This module 100 is connected to an ECU 101 through wire harnesses. The ECU 100 produces respective relay driving signals for the relay driving apparatuses 1. According to this embodiment, no wire harnesses are required to detect voltages at the junctions between the relay contacts 2*b* and the loads 3, as opposed to the conventional apparatus shown in FIG. 5.

The present invention should not be limited to the disclosed embodiments, but may be modified in various ways without departing from the spirit of the invention.

What is claimed is:

1. A relay driving apparatus for a relay having a relay coil and a relay contact, comprising:

a control circuit for supplying a first voltage to the relay coil in response to a relay driving signal to turn on the relay contact, and thereafter supplying a second voltage to the relay coil to keep an ON state of the relay contact; and a detection circuit, connected in a current supply path for supplying a coil current to the relay coil, for detecting a state change of the relay contact to an OFF state from the ON state based on a current change in the coil current, wherein the control circuit supplies the first voltage again to the relay coil in response to the state change detected by the detection circuit, wherein the detection circuit produces a detection signal indicative of the state change when the current change reaches a predetermined threshold.

2. The relay driving apparatus according to claim 1, wherein the control circuit has:

a timer circuit for producing an output signal after an elapse of a predetermined period in response to the detection signal from the detection circuit; and a circuit for supplying the first voltage to the relay coil again in response to the output signal from the timer circuit.

3. A relay driving apparatus for a relay having a relay coil and a relay contact, comprising:

a control circuit for supplying a first voltage to the relay coil in response to a relay driving signal to turn on the relay contact, and thereafter supplying a second voltage to the relay coil to keep an ON state of the relay contact; and a detection circuit, connected in a current supply path for supplying a coil current to the relay coil, for detecting a state change of the relay contact to an OFF state from the ON state based on a current change in the coil current, wherein the control circuit supplies the first voltage again to the relay coil in response to the state change detected by the detection circuit, wherein the current detection circuit has a current detection resistor connected in the current supply path and an amplifier for receiving a voltage across the resistor, so that the state change is detected based on a change of the voltage across the current detection resistor.

4. A relay driving apparatus for a relay having a relay coil and a relay contact, comprising:

a control circuit for supplying a first voltage to the relay coil in response to a relay driving signal to turn on the relay contact, and thereafter supplying a second voltage to the relay coil to keep an ON state of the relay contact; and a detection circuit, connected in a current supply path for supplying a coil current to the relay coil, for detecting a state change of the relay contact to an OFF state from the ON state based on a current change in the coil current, wherein the control circuit supplies the first voltage again to the relay coil in response to the state change detected by the detection circuit, wherein the control circuit and the current detection circuit are provided for each of a plurality of relays.

5. A relay driving method for driving a relay having a relay coil and a relay contact connected in series with an electric load and a power source, comprising steps of:

supplying a voltage of a first value to the relay coil for a predetermined period in response to a relay driving signal to turn on the relay contact from an OFF state;

decreasing the voltage to a second value after the predetermined period to keep an ON state of the relay contact as long as the relay driving signal is applied;

detecting a state change of the relay contact to an OFF state from the ON state based on a current change in a coil current flowing in the relay coil after the predetermined period; and increasing the voltage from the second value in response to the state change detected by the detecting step thereby to restore the ON state of the relay contact again, wherein the detecting step detects the state change when the current change reaches a predetermined threshold.

6. A relay driving method for driving a relay having a relay coil and a relay contact connected in series with an electric load and a power source, comprising steps of:

supplying a voltage of a first value to the relay coil for a predetermined period in response to a relay driving signal to turn on the relay contact from an OFF state;

decreasing the voltage to a second value after the predetermined period to keep an ON state of the relay contact as long as the relay driving signal is applied;

detecting a state change of the relay contact to an OFF state from the ON state based on a current change in a coil current flowing in the relay coil after the predetermined period; and increasing the voltage from the second value in response to the state change detected by the detecting step thereby to restore the ON state of the relay contact again, wherein the increasing step increases the voltage after an elapse of a predetermined period from a detection of the state change to avoid an arc current.

7. A relay driving method for driving a relay having a relay coil and a relay contact connected in series with an electric load and a power source, comprising steps of:

supplying a voltage of a first value to the relay coil for a predetermined period in response to a relay driving signal to turn on the relay contact from an OFF state;

decreasing the voltage to a second value after the predetermined period to keep an ON state of the relay contact as long as the relay driving signal is applied;

detecting a state change of the relay contact to an OFF state from the ON state based on a current change in a coil current flowing in the relay coil after the predetermined period; and increasing the voltage from the second value in response to the state change detected by the detecting step thereby to restore the ON state of the relay contact again, wherein the detecting step detects the state change based on a voltage developed by a resistor connected in series with the relay coil.

8. A relay driving method for driving a relay having a relay coil and a relay contact connected in series with an electric load and a power source, comprising steps of:

supplying a voltage of a first value to the relay coil for a predetermined period in response to a relay driving signal to turn on the relay contact from an OFF state;

decreasing the voltage to a second value after the predetermined period to keep an ON state of the relay contact as long as the relay driving signal is applied;

detecting a state change of the relay contact to an OFF state from the ON state based on a current change in a coil current flowing in the relay coil after the predetermined period; and increasing the voltage from the second value in response to the state change detected by the detecting step thereby to restore the ON state of the relay contact again, wherein the supplying step, the decreasing step, the detecting step and the increasing step are attained for each of the plurality of electric loads.

* * * * *